US005366804A

United States Patent [19]

Dugan

[11] Patent Number: 5,366,804

[45] Date of Patent: Nov. 22, 1994

[54] COMPOSITE FIBER AND MICROFIBERS MADE THEREFROM

[75] Inventor: Jeffrey S. Dugan, Asheville, N.C.

[73] Assignee: BASF Corporation, Parsippany, N.J.

[21] Appl. No.: 40,715

[22] Filed: Mar. 31, 1993

[51] Int. Cl.[5] ..... D02G 3/00

[52] U.S. Cl. ..... 428/373; 428/374; 428/370; 525/425

[58] Field of Search ..... 525/425; 428/364, 370, 428/374, 373; 264/147; 528/290

[56] References Cited

U.S. PATENT DOCUMENTS

| | | | |
|---|---|---|---|
| 3,369,057 | 2/1968 | Twilley | 525/425 |
| 3,382,305 | 5/1968 | Breen | 525/425 |
| 3,531,368 | 9/1970 | Okamoto et al. | 428/374 |
| 3,577,308 | 5/1971 | Marinus et al. | 264/147 |
| 3,584,074 | 6/1971 | Shima | 525/425 |
| 3,608,025 | 9/1971 | Mirsky | 264/147 |
| 3,629,365 | 12/1971 | Gardner | 525/425 |
| 3,729,449 | 4/1973 | Kimura | 525/425 |
| 3,734,874 | 5/1973 | Kibler et al. | 525/425 |
| 3,779,993 | 12/1973 | Kibler et al. | 525/425 |
| 4,233,355 | 11/1980 | Sato et al. | 428/374 |
| 4,304,901 | 12/1981 | O'Neill et al. | 528/290 |
| 4,381,335 | 4/1983 | Okamoto | 428/370 |
| 4,966,808 | 10/1990 | Kawano | 528/314 |
| 5,124,194 | 6/1992 | Kawano | 528/373 |

*Primary Examiner*—Newton O. Edwards

*Attorney, Agent, or Firm*—Frank G. Werner; Michael R. Chipaloski

[57] ABSTRACT

A composite fiber of at least two different polymers, one of which is water-insoluble and selected from the group consisting of polyester, polyamide and copolymers therefrom and the other is water-dissipatable, having a plurality of at least 19 segments of the water-insoluble polymer, uniformly distributed across the cross-section of the fiber and being surrounded by the water-dissipatable polymer, a process for the manufacture of such a fiber and a process for the manufacture of microfibers therefrom.

12 Claims, 8 Drawing Sheets

COMPOSITE FIBER AND MICROFIBERS MADE THEREFROM

FIELD OF THE INVENTION

The present invention relates to a composite fiber, and microfiber made therefrom, a process for the manufacture of the composite fiber as well as a process for the production of the microfiber. In particular it relates to a composite fiber, comprising a water insoluble and a water dissipatable polymer.

BACKGROUND OF THE INVENTION

Composite fibers and microfibers made therefrom as well as different processes for their manufacture are well known in the art.

The composite fibers are manufactured in general by combining at least two incompatible fiber-forming polymers via extrusion followed by optionally dissolving one of the polymers from the resultant fiber to form microfibers.

U.S. Pat. No. 3,700,545 discloses a multi-segmented polyester or polyamide fiber having at least 10 fine segments with cross sectional shapes and areas irregular and uneven to each other.

The spun fibers are treated with an alkali or an acid to decompose and at least a part of the polyester or polyamide is removed.

Described is a complex spinnerette for the manufacture of such fibers.

U.S. Pat. No. 3,382,305 discloses a process for the formation of microfibers having an average diameter of 0.01 to 3 micron by blending two incompatible polymers and extruding the resultant mixture into filaments and further dissolving one of the polymers from the filament. The disadvantage if this process is that the cross section of these filaments is very irregular and uneven and the islands, which form the microfibers after the hydrolysis, are discontinuous, which means that they are not continuous over the length of the composite fibers.

U.S. Pat. No. 5,120,598 describes ultra-fine polymeric fibers for cleaning up oil spills. The fibers were produced by mixing an polyolefin with poly (vinyl alcohol) and extruding the mixture through a die followed by further orientation. The poly (vinyl alcohol) is extracted with water to yield ultra-fine polymeric fibers. A disadvantage of this process is the limitation of the polymers to the polyolefin family because of their relative low melting point. At higher temperatures which are necessary for the extrusion of polyamides or polyesters, the poly (vinyl alcohol) decomposes.

EP-A-0,498,672 discloses microfiber generating fibers of island-in-the-sea type obtained by melt extrusion of a mixture of two polymers, whereby the sea polymer is soluble in a solvent and releases the insoluble island fiber of a fineness of 0.01 denier or less. Described is polyvinyl alcohol as the sea polymer, which limits the application to the polyolefin polymer family because of their relative low melting point. Another disadvantage is that by the process of melt mixing the islands-in-the-sea cross section is irregular and uneven and the islands, which form the microfibers after the hydrolysis, are discontinuous, which means that they are not continuous over the length of the composite fibers.

U.S. Pat. No. 4,233,355 discloses a separable unitary composite fiber comprised of a polyester or polyamide which is insoluble in a given solvent and a copolyester of ethylene terephthalate units and ethylene 5-sodium sulfoisophthalate units, which is soluble in a given solvent. The composite fiber was treated with an aqueous alkaline solution to dissolve out at least part of the soluble polymer component to yield fine fibers. The cross sectional views of the composite fibers show an "islands-in-a-sea" type, where the "Islands" are the fine fibers of the insoluble polymer surrounded by the "sea" of the soluble polymer. The highest described number of segments or "islands" are 14 and the lowest described fineness were 108 filaments having a total fineness of 70 denier which corresponds to 0.65 denier per filament.

Object of the present invention is to provide a composite fiber with a cross-section having at least 19 segments of a water-insoluble polymer, surrounded by a water dissipatable polymer, which is not limited to polyolefins as the water-insoluble polymer and which is applicable to polymers with a higher melting and processing temperature and wherein the segments of water insoluble polymer are uniformly distributed across the cross-section of the composite fiber and are continuous over the length of the composite fiber.

Another object was to provide a process for the manufacture of such a composite fiber.

Another object was to provide a process for the manufacture of microfibers of a fineness of not greater than 0.3 denier from the composite fibers.

SUMMARY OF THE INVENTION

The objects of the present invention could be achieved by a composite fiber comprising at least two different polymers, one of which is water-insoluble and selected from the group consisting of polyester, copolyester, polyamide and copolyamide and the other is water-dissipatable, having a plurality of at least 19 segments of the water-insoluble polymer, uniformly distributed across the cross-section of the fiber and being surrounded by the water-dissipatable polymer.

DETAILED DESCRIPTION OF THE INVENTION

Figure 1:
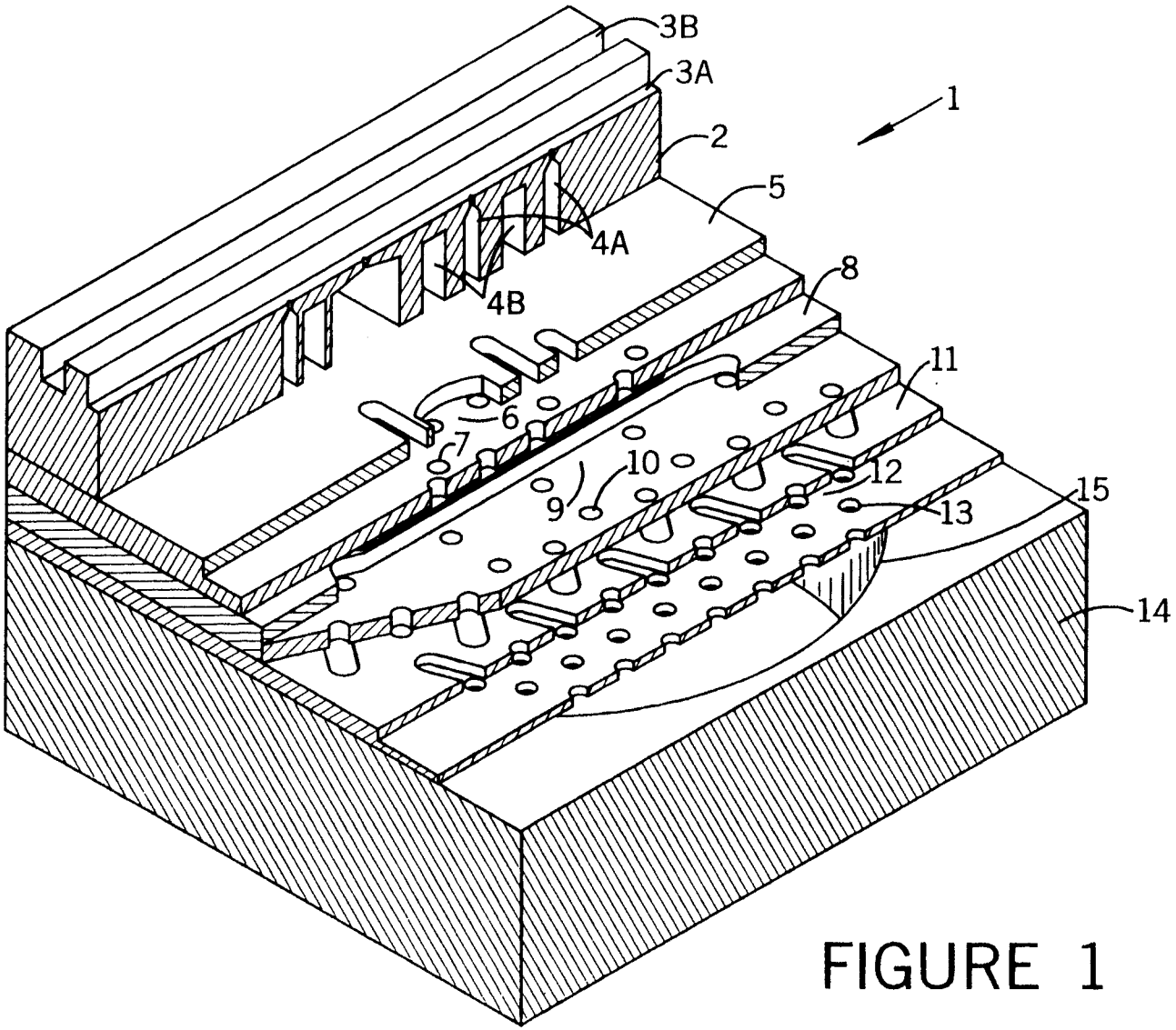
FIG. 1 is a view in perspective of a spin pack assembly.

Composite fibers are made by melting the two fiber forming polymers in two seperate extruders and by directing the two polymer flows into one spinnerette with a plurality of distribution flow paths in form of small thin tubes which are made for example, by drilling. U.S. Pat. No. 3,700,545 describes such a complex spinnerette.

In contrast to the complex, expensive and imprecise machined metal devices of the prior art, the spinnerette pack assembly of the present invention uses etched plates like they are described in U.S. Pat. No. 5,162,074.

A distributor plate or a plurality of adjacently disposed distributor plates in a spin pack takes the form of a thin metal sheet in which distribution flow paths are etched to provide precisely formed and densely packed passage configurations. The distribution flow paths may be: etched shallow distribution channels arranged to conduct polymer flow along the distributor plate surface in a direction transverse to the net flow through the spin pack; and distribution apertures etched through the distributor plate. The etching process, which may be photochemical etching, is much less expensive than the drilling, milling, reaming or other machining/cutting processes utilized to form distribution paths in the thick plates utilized in the prior art. Moreover, the thin distribution plates with thicknesses for example of less than 0.10 inch, and typically no thicker than 0.030 inch are themselves much less expensive than the thicker distributor plates conventionally employed in the prior art.

Etching permits the distribution apertures to be precisely defined with very small length (L) to diameter (D) ratios of 1.5 or less, and more typically, 0.7 or less. By flowing the individual plural polymer components to the disposable distributor plates via respective groups of slots in a non disposable primary plate, the transverse pressure variations upstream of the distributor plates are minimized so that the small L/D ratios are feasible. Transverse pressure variations may be further mitigated by interposing a permanent metering plate between the primary plate and the etched distribution plates. Each group of slots in the primary non-disposable plate carries a respective polymer component and includes at least two slots. The slots of each group are positionally alternated or interlaced with slots of the other groups so that no two adjacent slots carry the same polymer component.

The transverse distribution of polymer in the spin pack, as required for plural-component fiber extrusion, is enhanced and simplified by the shallow channels made feasible by the etching process. Typically the depth of the channels is less than 0.016 inch and, in most cases, less than 0.010 inch. The polymer can thus be efficiently distributed, transversely of the net flow direction in the spin pack, without taking up considerable flow path length, thereby permitting the overall thickness for example in the flow directing of the spin pack to be kept small. Etching also permits the distribution flow channels and apertures to be tightly packed, resulting in a spin pack of high productivity (i.e., grams of polymer per square centimeter of spinnerette face area). The etching process, in particular photo-chemical etching, is relatively inexpensive, as is the thin metal distributor plate itself. The resulting low cost etched plate can, therefore, be discarded and economically replaced at the times of periodic cleaning of the spin pack. The replacement distributor plate can be identical to the discarded plate, or it can have different distribution flow path configurations if different polymer fiber configurations are to be extruded. The precision afforded by etching assures that the resulting fibers are uniform in shape and denier.

The process for the manufacture of the composite fiber of the present invention is described with reference to FIG. 1 to 7.

FIG. 1 shows a spin pack assembly (1) for the manufacture of the composite fiber of the present invention, which includes a distribution plate (2) with polymer flow channels (3), channel (3A) is designated for the water-insoluble and microfiber forming polymer and channel (3B) for the water-dissipatable polymer and the slots (4), slot (4A) is designated for the water-insoluble and microfiber forming polymer and slot (4B) for the water-dissipatable polymer. Below the distribution plate (2) is a top etched plate (5) with etched areas (6) and through etched areas (7), followed by a middle etched plate (8) with etched areas (9) and through etched areas (10), followed by a bottom etched plate (11) with etched areas (12) and through etched areas (13), followed by a spinnerette plate (14) with a backhole (15).

Figure 2:
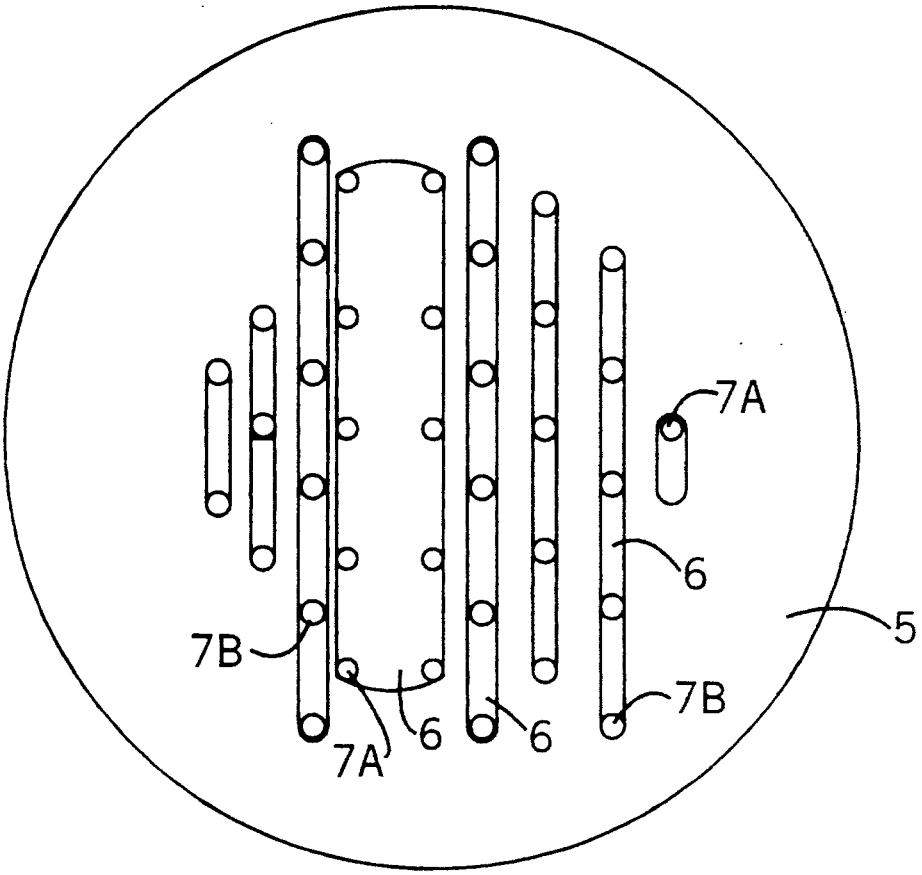
FIG. 2 is a top view in plane of a top etched plate.

FIG. 2 shows a top etched plate (5) having etched areas (6), in which the polymer flows transversely of the net flow direction in the spin pack, and through etched areas (7), through which the polymer flows in the net flow direction. Through etched areas (7A) are designated for the water-insoluble and microfiber-forming polymer and through-etched areas (7B) are designated for the water-dissipatable polymer.

Figure 3:
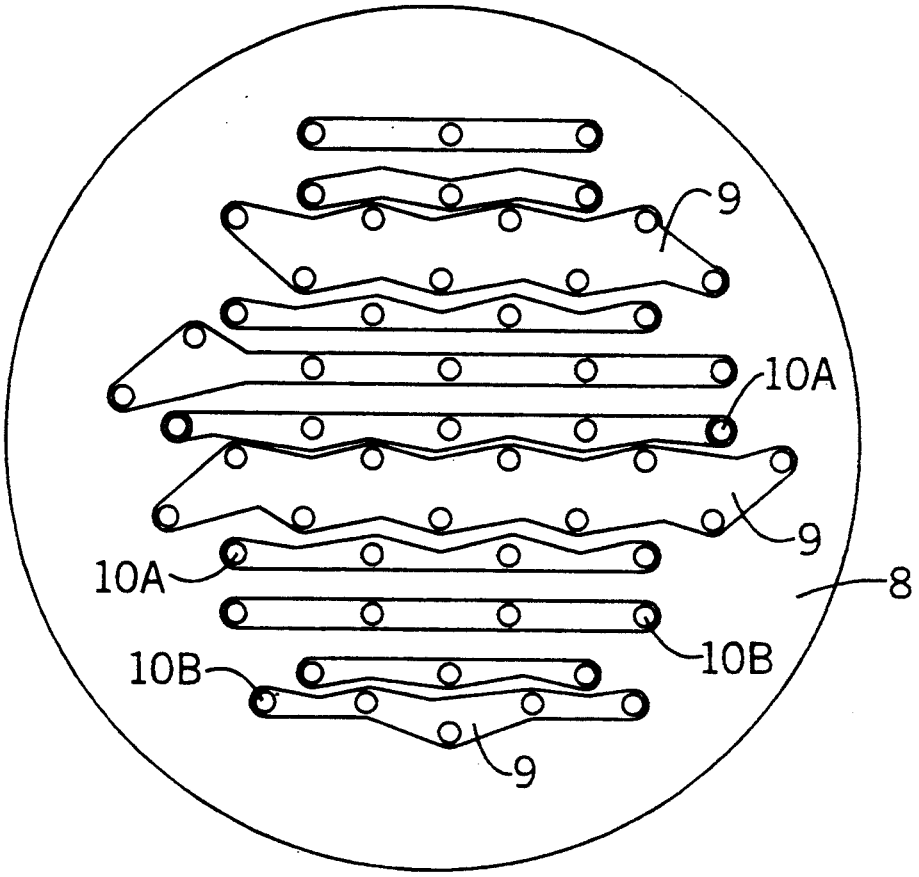
FIG. 3 is a top view in plane of a middle etched plate.

FIG. 3 shows a middle etched plate (8) having etched areas (9) and through-etched areas (10), whereby (10A) is designated for the water-insoluble polymer and (10B) is designated for the water dissipatable polymer.

Figure 4:
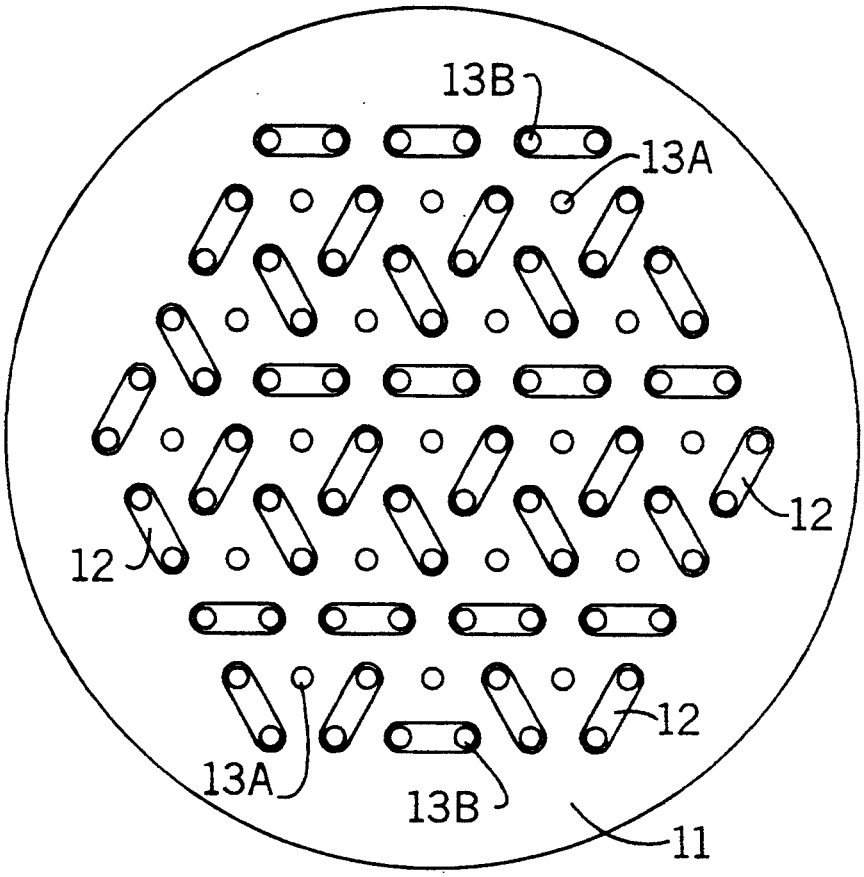
FIG. 4 is a top view in plane of a bottom etched plate with 19 island holes.

FIG. 4 shows a bottom etched plate (11) having etched areas (12) and through-etched areas (13), whereby (13A) is designated for the water-insoluble polymer and (13B) is designated for the water-dissipatable polymer.

Figure 5:
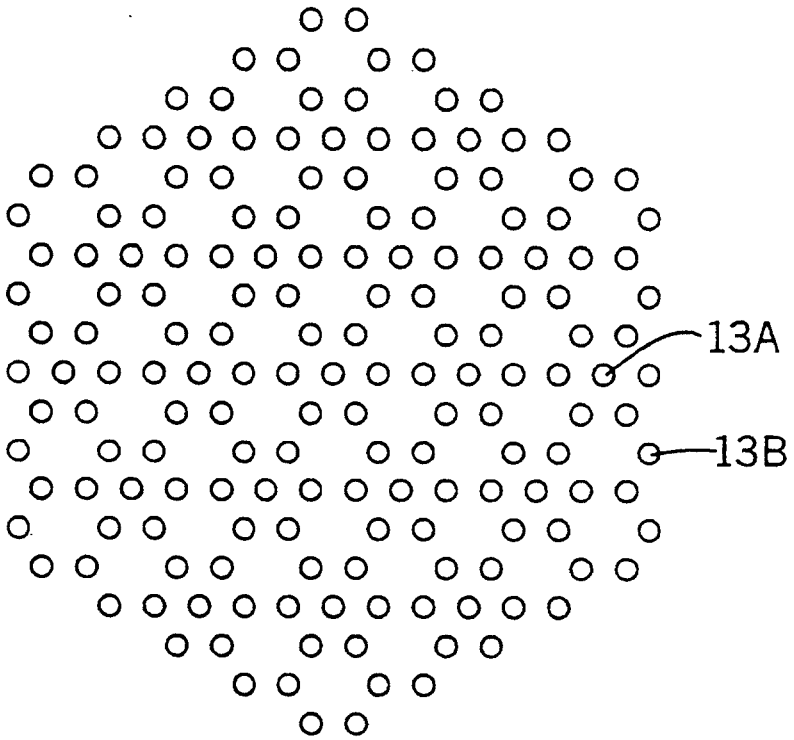
FIG. 5 is a top view in plane of "honeycomb" hole pattern of a bottom etched plate with 19 holes which form the islands in the fiber.

FIG. 5 shows a "honeycomb" hole pattern of a bottom etched plate (11), which has 19 holes for the water-insoluble polymer (13A) which forms the islands-in-the-sea of the water-dissipatable polymer, which flows through holes (13B).

Figure 6:
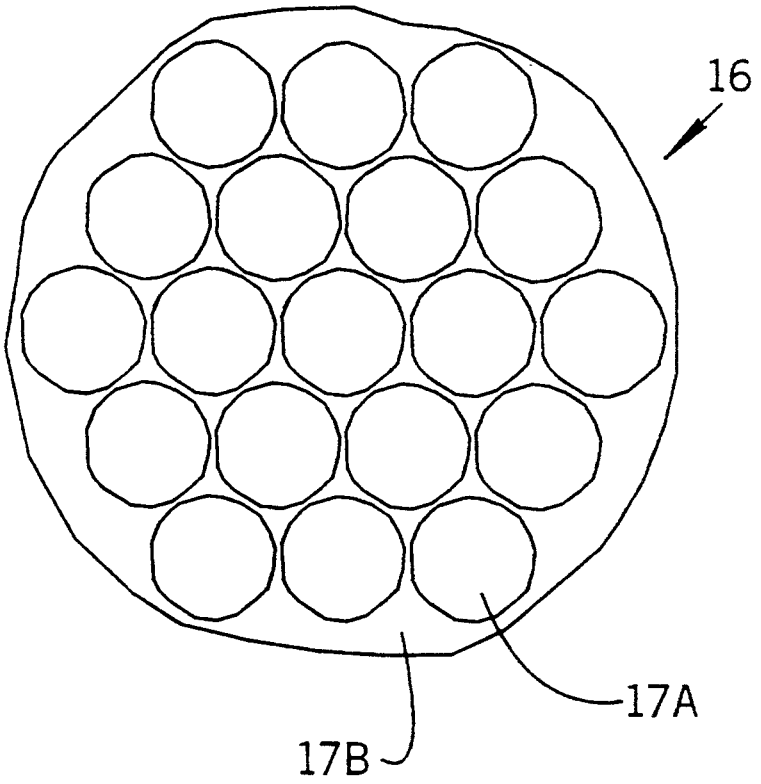
FIG. 6 is a top view in plane of a cross section of a composite fiber with 19 islands in a "honeycomb" pattern.

FIG. 6 shows a cross section of a composite fiber (16) of the present invention with 19 islands of the water insoluble polymer (17A) in the sea of the water-dissipatable polymer (17B) in a "honeycomb" pattern.

Figure 7:
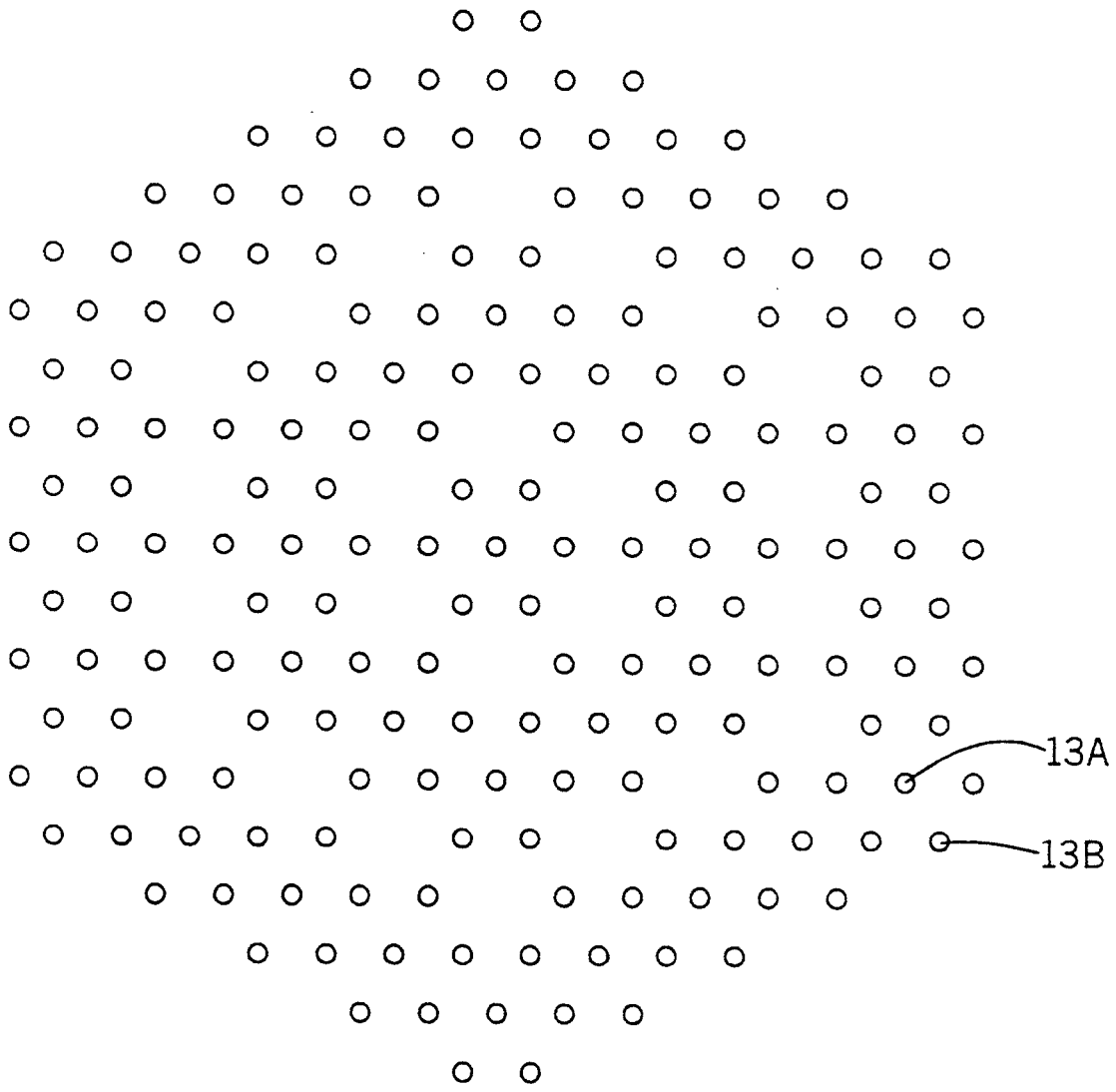
FIG. 7 is a top view in plane of a bottom etched plate with 37 holes which form the islands in the fiber.

FIG. 7 shows a hole pattern of a bottom etched plate (11), which has 37 holes for the water insoluble polymer (13A) and the other holes for the water-dissipatable polymer (13B).

Figure 8:
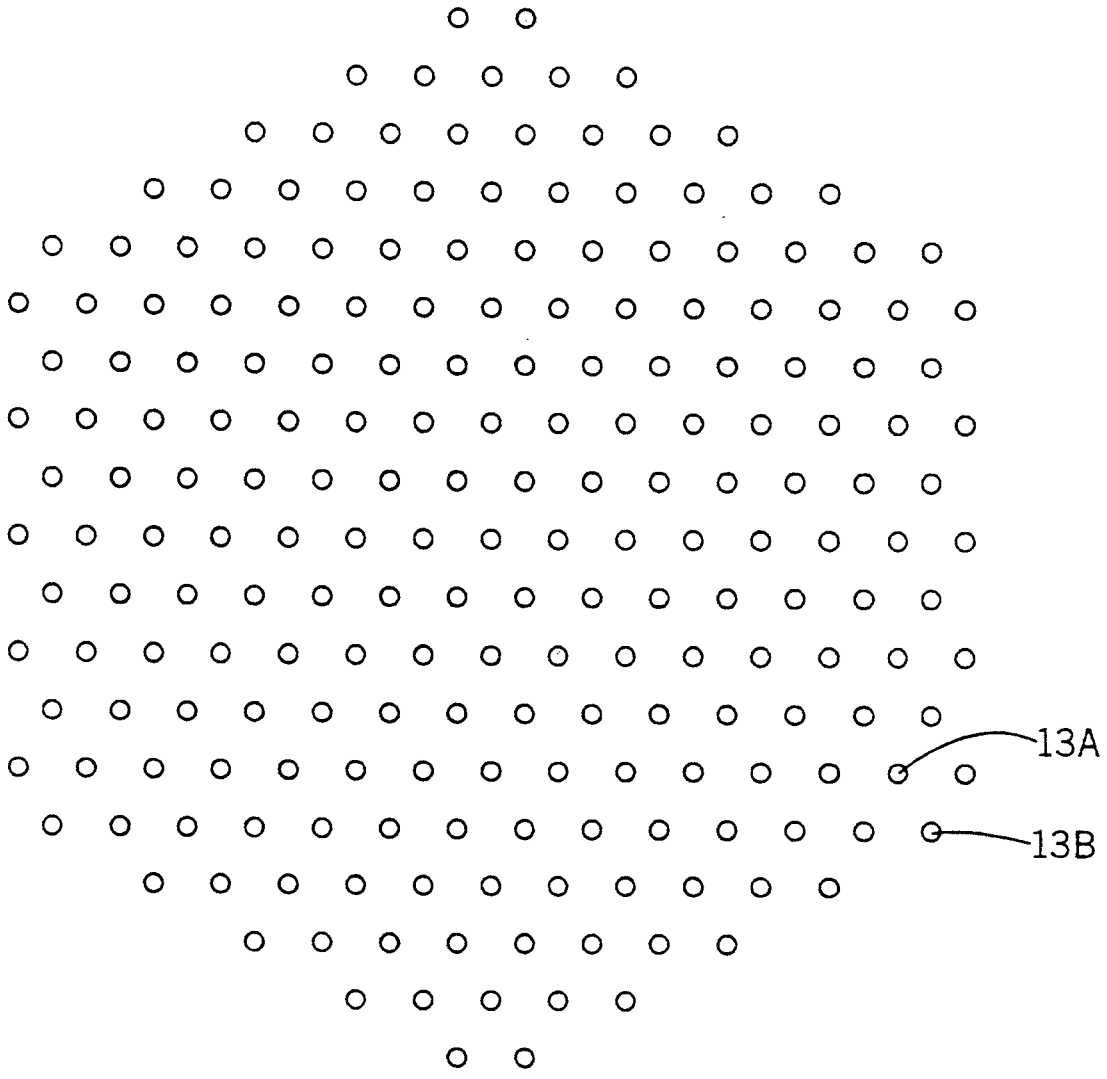
FIG. 8 is a top view in plane of a bottom etched plate with 61 holes which form the islands in the fiber.

FIG. 8 shows a hole pattern of a bottom etched plate (11), which has 61 holes for the water insoluble polymer (13A) and the other holes for the water-dissipatable polymer (13B).

The etched plate of FIG. 4 has at least 19 through etched areas (12), which are holes through which the water insoluble polymer flows, preferably at least 30 and most preferred at least 50 through etched areas (12) so that a composite fiber, manufactured with such a spin pack has a cross section with at least 19 segments, preferable at least 30 segments and most preferred with at least 50 segments of the water-insoluble polymer as the islands-in-the-sea of the water-dissipatable polymer.

FIGS. 4 and 5 show an etched plate having a "honeycomb" hole pattern which has 19 holes for the water-insoluble polymer (13A), each hole is surrounded by 6 holes for the water-dissipatable polymer (13B). The result is that there is no theoretical limit to the ratio of "islands" material to "sea" material. As this ratio increases from examples 30:70 to 70:30, the "island" microfilaments go from round shapes in a "sea" of soluble polymer to tightly-packed hexagons with soluble walls between the hexagons. As this ratio increases further, the walls simply become thinner.

The practical limit is at which many of these walls are breached and adjacent microfilaments fuse. But the removal of the theoretical limit is new. For instance, if the microfilaments are arranged in a square grid arrangement, the maximum residual polymer content at the point of fusing is 78.5%

It is of high economic interest, to achieve fiber smallness by increasing the number of islands and to reduce the expense of consuming and disposing of the residual "sea" polymer by minimizing its content in the composite fibers.

With etched plates having this honeycomb pattern composite fibers could be manufactured with a cross-section having more than 60 segments of water-insoluble polymer surrounded by the water-dissipatable polymer.

The water-insoluble polymers comprise polyesters, copolyesters, polyamides and copolyamides.

Suitable polyesters and copolyesters are prepared for example by the condensation of aromatic dicarboxylic acids such as terephthalic acid, isophthalic acid, phthalic acid and naphthalene-2,6-dicarboxylic acid, aliphatic dicarboxylic acids such as adipic acid and sebacic acid or their esters with diol compounds such as ethylene glycol diethylene glycol, 1,4-butanediol, neopentyl glycol and cyclohexane-1,4-dimethanol.

Preferred are polyethylene terephthalate and polybutylene terephthalate and most preferred is polyethylene terephthalate.

Polyamides and copolyamides are well known by the general term "nylon" and are long chain synthetic polymers containing amide (—CO—NH—) linkages along the main polymer chain. Suitable fiber-forming or melt spinnable polyamides of interest for this invention include those which are obtained by the polymerization of a lactam or an amino acid, or those polymers formed by the condensation of a diamine and dicarboxylic acid. Typical polyamides include nylon 6, nylon 6/6, nylon 6/10, nylon 6/12, nylon 6T, nylon 11, nylon 12 and copolymers thereof or mixtures thereof. Polyamides can also be copolymers of nylon 6 or nylon 6/6 and a nylon salt obtained by reacting a dicarboxylic acid component such as terephthalic acid adipic acid or sebacic acid with a diamine such as hexamethylene diamine, meta xylene diamine, or 1,4-bisaminomethyl cyclohexane. Preferred are poly-epsilon-caprolactam (nylon 6) and polyhexamethylene adipamide (nylon 6/6.). Most preferred is nylon 6.

Water-dissipatable polymers suitable for the present invention is described in U.S. Pat. Nos. 3,734,874; 3,779,993 and 4,304,901, the disclosures thereof are incorporated by reference. Suitable polymers include polyesters which comprise (i) at least one difunctional dicarboxylic acid, (ii) from about 4 to about 25 mole percent, based on a total of all acid, hydroxyl and amino equivalents being equal to 200 mole percent, of at least one difunctional sulfomonomer containing at least one metal sulfonate group attached to an aromatic nucleus wherein the functional groups are hydroxyl, carboxyl or amino, and, (iii) at least one difunctional reactant like glycol or a mixture of glycol amd diamine, at least 15 mole percent based on the total mole percent of hydroxy and amino equivalents is poly (ethylene glycol) of the formula $$H(OC_2H_4)_nOH$$

with n being an integer of between 2 and about 20.

Preferred dicarboxylic acids are (i) terepthalic acid and isopthalic acid, a preferred sulfamonomer (ii) is isopthalic acid containing a sodiumsulfonate group, and preferred glycols (iii) are ethylene glycol and diethylene glycol.

A preferred polyester comprises at least 80 mole percent isopthalic acid, about 10 mole percent 5-sodium sulfaisopthalic acid and diethylene glycol.

The inherent viscosity of the polyesters, measured in a 60/40 parts by weight solution of phenol/tetrachloroethane at 25° C. and at a concentration of 0.25 gram of polyester in 100 ml solvent, is at least 0.1, preferably at least 0.3.

An example of a suitable polyester is commercially available as AQ55S from Eastman Chemical Corporation.

In the process for the manufacture of the composite fibers, the water-insoluble polymer and the water-dissipatable polymer are molten in step (a) in two seperate exruders into two melt flows whereby the water-insoluble polymer flow is directed into the channel 3(A) of the spinnerette assembly and through slots (4A) to the etched plates (5) (8) and (11) of the spinnerette assembly and the water-dissipatable polymer is directed into the channel (3B) and through slot (4B) to the etched plates (5) (8) and (11) of the spinnerette assembly. The composite fibers exit the spinnerette assembly and are spun in step (a) with a speed of from about 100 to about 10,000 m/min, preferably with about 800 to about 2000 m/min.

The extruded composite fibers are quenched in step (b) with a cross flow of air and solidify. During the subsequent treatment of the fibers with a spin finish in step (c) it is important to avoid a premature dissolution of the water-dissipatable polymer in the water of the spin finish. For the present invention the finish is prepared as 100% oil (or "neat") like butyl stearate, trimethylolpropane triester of caprylic acid, tridecyl stearate, mineral oil and the like and applied at a much slower rate than is used for an aqueous solution and/or emulsion of from about 3% to about 25%, preferably from about 5% to about 10% weight. This water-free oil is applied at about 0.1 to about 5% by weight, preferably 0.5 to 1.5% by weight based on the weight of the fiber and coats the surface of the composite filaments. This coating reduces destructive absorption of atmospheric moisture by the water-dissipatable polymer. It also reduces fusing of the polymer between adjacent composite filaments if the polymer softens during the subsequent drawing step.

Other additives may be incorporated in the spin finish in effective amounts like emulsifiers, antistatics, antifoams, thermostabilizers, UV stabilizers and the like.

The fibers or filaments are then drawn in step (d) and, in one embodiment, subsequently textured and wound-up to form bulk continuous filament (BCF). The one-step technique of BCF manufacture is known in the trade as spin-draw-texturing (SDT). Two step technique which involves spinning and a subsequent texturing is also suitable for the manufacturing BCF of this invention.

Other embodiments include flat filament (non-textured) yarns, or cut staple fiber, either crimped or uncrimped.

The process for the manufacture of microfiber fabrics comprises in step (e) converting the yarn of the present invention into a fabric by any known fabric forming process like knitting, needle punching, and the like.

In the hydrolyzing step (f) the fabric is treated with water at a temperature of from about 10° to about 100° C., preferably from about 50° to about 80° C. for a time period of from about 1 to about 180 seconds whereby the water-dissipatable polymer is dissipated or dissolved.

The microfibers of the fabric have an average fineness of less than 0.3 denier per filament (dpf), preferably less than 0.1 and most preferred less than 0.01 dpf and the fabric has a silky touch.

EXAMPLE

Polyethylene terephthalate (PET), (BASF T-741 semi-dull) was fed through an extruder into the top of a bicomponent spin pack containing etched plates designed to make an islands-in-the-sea cross section with 61 islands. The PET was fed into the spin pack through the port for the "island" polymer. Simultaneously, a polyester containing 5-sodium sulfoisopthalic units with a melting point of about 80° C. (Eastman AQ55S polymer) mixed with a green pigment chip to aid in distinguishing the two polymers was fed through a separate extruder into the same spin pack, through the port for the "sea" polymer. The pressure in both extruders was 1500 psig, and temperature profiles were set as follows:

| | PET | AQ55S |
|---|---|---|
| Extruder zone 1 | 280° C. | 200° C. |
| Extruder zone 2 | 285° C. | 225° C. |
| Extruder zone 3 | 285° C. | 250° C. |
| Die head | 287° C. | 270° C. |
| Polymer header | 280° C. | 280° C. |
| Pump block | 290° C. | 290° C. |

A metering pump pumped the molten PET through the spin pack at 52.5 g/min. and the AQ55S was pumped at 17.5 g/min. The two polymers exited the spin pack through a 37-hole spinnerette as 37 round filaments each comprising 61 PET filaments bound together by AQ55S polymer. The molten filaments were solidified by cooling as they passed through a quench chamber with air flowing at a rate of 130 cubic feet per minute across the filaments. The quenched yarn passed across a metered finish applicator applying a 100% oil finish at a rate of 0.83 $cm^3$/minute, and was then taken up on a core at 1050 m/min. At this point, the yarn had 37 filaments and a total denier of about 600.

The yarn was then drawn on an SZ-16 type drawtwister at a speed of 625 m/min. The first stage draw ratio was 1.0089 and the second stage draw ratio was 2.97. Spindle speed was 7600 rpm, lay rail speed was 18 up/18 down, builder gears used were 36/108, 36/108, 48/96, and 85/80, tangle jet pressure was 30 psig, heated godet temperature was 100° C., and hot plate temperature was 165° C. After drawing, the yarn had a total denier of about 200.

The drawn yarn was used as filling in a five-harness satin weave fabric. The woven fabric was scoured in a standard polyester scour, and dyed navy blue using a standard polyester dyeing process. Before scouring, the fabric was a solid and even green color, since the AQ55S was pigmented green. After scouring, the fabric was white. This and subsequent microscopy investigation confirmed that the standard scour was sufficient to remove virtually all of the AQ55S. Since the AQ55S comprised about 25% of the yarn before scouring, the scouring reduced the denier of the fill yarns to about 140. However, the removal of the AQ55S also liberated the individual PET filaments, so the scoured fill yarns each contained 2257 PET filaments. The average PET filling filament, then, had a linear density of 0.06 denier.

What is claimed is:

1. A composite fiber with an island-in-a-sea cross section comprising at least two different polymers, one of which is a water-insoluble polymer and selected from the group consisting of polyester, polyamide and copolymers therefrom, and an other is water-dissipatable polymer having a plurality of at least 19 islands of the water insoluble polymer, the islands having an average fineness of not greater than 0.3 denier per filament and being uniformly distributed across the cross section of the fiber and being continuous over the length of the composite fiber and being surrounded by the sea of the water-dissipatable polymer.

2. The fiber according to claim 1, wherein the water-insoluble polymer is selected from the group consisting of polyethylene terephthalate, polybutylene terephthalate, nylon 6, nylon 6,6, nylon 10, nylon 11, nylon 12, nylon 6,10 and copolymers therefrom.

3. The fiber according to claim 2, wherein the water-insoluble polymer is selected from the group consisting of polyethylene terephthalate, nylon 6 and nylon 6,6.

4. The fiber according to claim 1, wherein the water-dissipatable polymer comprising the reaction product of (i) at least one difunctional dicarboxylic acid;

(ii) from about 4 to about 40 mole percent, based on a total of all acid, hydroxyl and amino equivalents being equal to 200 mole percent, of at least one difunctional sulfomonomer containing at least one metal sulfonate group attached to aromatic nucleus wherein the functional groups are hydroxy, carboxyl or amino; and (iii) at least one difunctional reactant selected from a glycol or a mixture of a glycol and diamine, at least 15 mole percent based on the total mole percent of hydroxy and amino equivalents, is a poly(ethylene glycol) having the structural formula:

$$H(OC_2H_4)_nOH$$

n being an integer of between 2 and about 20.

5. The fiber according to claim 4, wherein the difunctional dicarboxylic acid (i) is selected from the group consisting of terepthalic acid, isopthalic acid and mixtures thereof.

6. The fiber according to claim 4, wherein the difunctional sulfomonomer (ii) is a metal sulfoisopthalic acid.

7. The fiber according to claim 4, wherein the difunctional reactant (iii) is diethylene glycol.

8. The fiber according to claim 1, having a plurality of at least 30 islands of the water-insoluble polymer.

9. The fiber according to claim 1, wherein the islands have a round shape.

10. The fiber according to claim 1, wherein the islands have a honeycomb shape.

11. The fiber according to claim 10, wherein the fineness is not greater than 0.1 denier per filament.

12. The fiber according to claim 10, wherein the fineness is not greater than 0.02 denier per filament.

* * * * *